US007254971B2

(12) United States Patent
Ruan

(10) Patent No.: US 7,254,971 B2
(45) Date of Patent: Aug. 14, 2007

(54) COMBINATION LOCK

(75) Inventor: Jiaqiang Ruan, Kowloon (HK)

(73) Assignee: Path Line (Ng's) Holding Limited, T.S.T., Kowloon (HK)

( * ) Notice: Subject to any disclaimer, the term of this patent is extended or adjusted under 35 U.S.C. 154(b) by 0 days.

(21) Appl. No.: 11/223,852

(22) Filed: Sep. 9, 2005

(65) Prior Publication Data

US 2007/0056333 A1 Mar. 15, 2007

(51) Int. Cl.
*E05B 37/00* (2006.01)

(52) U.S. Cl. ..... 70/25; 70/21

(58) Field of Classification Search ..... 70/22–29, 70/286, 291, 312, 314–315, 21
See application file for complete search history.

(56) References Cited

U.S. PATENT DOCUMENTS 4,615,191 A * 10/1986 Grandy ..... 70/26
5,005,384 A * 4/1991 Lo et al. ..... 70/25
5,934,120 A * 8/1999 Kuo ..... 70/312
6,058,744 A * 5/2000 Ling ..... 70/28
6,799,446 B1 * 10/2004 Tsai ..... 70/30
2006/0169007 A1 * 8/2006 Fiegener ..... 70/25

FOREIGN PATENT DOCUMENTS

WO WO96/38643 * 12/1996

* cited by examiner

*Primary Examiner*—Brian E. Glessner
*Assistant Examiner*—Kristina R Gluchowski
(74) *Attorney, Agent, or Firm*—Raymond Y. Chan; David and Raymond Patent Group

(57) ABSTRACT

A combination lock includes a lock body, a locking latch, a numerical actuation unit including a plurality of number rotors and a plurality of locking rings, and a password reset unit. The password reset unit includes a reset driver slidably extended at the lock body to couple with the locking rings, wherein when the reset driver is moved to drive the locking rings to slidably disengage with number rotors, the number rotors are free to rotate on the lock body to reset a new number-combination, such that when the reset driver is released that the locking rings are slidably returned back within the number rotors, the detachable end of the locking latch is unlocked once the number rotors are rotated at the new number-combination.

16 Claims, 10 Drawing Sheets

COMBINATION LOCK

BACKGROUND OF THE PRESENT INVENTION

1. Field of Invention

The present invention relates to a lock, and more particularly to a combination lock which comprises a password reset unit received in a lock body for preventing it from being accidentally actuated.

2. Description of Related Arts

Locks have been widely used for a wide variety of purposes. For example, a mini-lock may be utilized to lock up a user's luggage for preventing it from being unauthorizedly or accidentally opened.

A conventional combination lock usually comprises a lock body, a locking latch outwardly extended from the lock body, a numerical actuation unit comprising a plurality of ring-shaped number rotors rotatably mounted in the lock body for locking and unlocking the locking latch with respect to the lock body, and a password resetting unit operatively communicated with the numerical actuation unit for allowing a user to reset a numerical-combination, i.e. password, of the numerical actuation unit for unlocking the locking latch.

As a matter of conventional arts, the password reset unit usually comprises a password reset button provided on the lock body and a password resetting mechanism mounted in the lock body for coupling between the numerical actuation unit and the password reset button, in such a manner that when the password reset button is actuated, the password resetting mechanism will disengage with the numerical actuation unit for allowing resetting of the numerical combination.

A main disadvantage of this kind of conventional combination lock is that the password reset button is positioned on the lock body so that it may be accidentally actuated. In such a scenario, if the user does not notice of the actuation of the password reset button, the number rotors may be accidentally rotated when the password reset button is unknowingly actuated. The consequence is that the numerical-combination of the combination lock is reset without the user knowing of the new password.

In order to cater for this disadvantage, there exists another kind of combination lock comprising a lock body which comprises a first and a second body portions detachably attached with each other for enclosing a password reset unit within the lock body. When the user wishes to reset the numerical-combination of the combination lock, he/she needs to disassemble the lock body in order to gain access to the password reset unit. A main disadvantage of this kind of combination lock is that reset of password is troublesome and very convenient, though substantially resolving the above-mentioned disadvantage of accidental resetting of passwords.

SUMMARY OF THE PRESENT INVENTION

A main object of the present invention is to provide a combination lock which comprising a password reset unit received in a lock body for preventing it from being accidentally actuated.

Another object of the present invention is to provide a combination lock comprising a password reset unit which allows a user to reset a password of the combination lock on a lock body thereof without needing to disassemble the lock body. In other words, the password reset unit allows maximum convenience of resetting the password while substantially preventing accidental resetting of the password.

Another object of the present invention is to provide a combination lock which does not involve complicated mechanical structure so as to minimize the manufacturing cost as well as the ultimate selling price of the present invention.

Accordingly, in order to accomplish the above objects, the present invention provides a combination lock, comprising:

a lock body having a first latch opening and a second latch opening spacedly formed on the lock body;

a locking latch having a coupling end portion slidably mounted at the first latch opening and a detachable end portion detachably engaged at the second latch opening;

a numerical actuation unit which comprises a lock releasing device slidably supported by the lock body to lock up the detachable end portion of the locking latch at the second latch opening, a plurality of locking rings spacedly disposed in the lock body to lock up the lock releasing device in a slidably movable manner, a plurality of ring-shaped number rotors rotatably provided on the lock body to coaxially engage with the locking rings respectively, wherein when the number rotors are rotated at a predetermined number-combination, the locking rings are driven to rotate to unlock the lock releasing device, such that the detachable end portion of the locking latch is free to detach from the lock body at the second latch opening; and a password reset unit which comprises a reset driver slidably extended at the lock body to couple with the locking rings, wherein when the reset driver is moved to drive the locking rings to slidably disengage with the number rotors, the number rotors are free to rotate on the lock body to reset a new number-combination, such that when the reset driver is released that the locking rings are slidably returned back within the number rotors, the detachable end of the locking latch is unlocked once the number rotors are rotated at the new number-combination.

These and other objectives, features, and advantages of the present invention will become apparent from the following detailed description, the accompanying drawings, and the appended claims.

DETAILED DESCRIPTION OF THE PREFERRED EMBODIMENT

Figure 1:
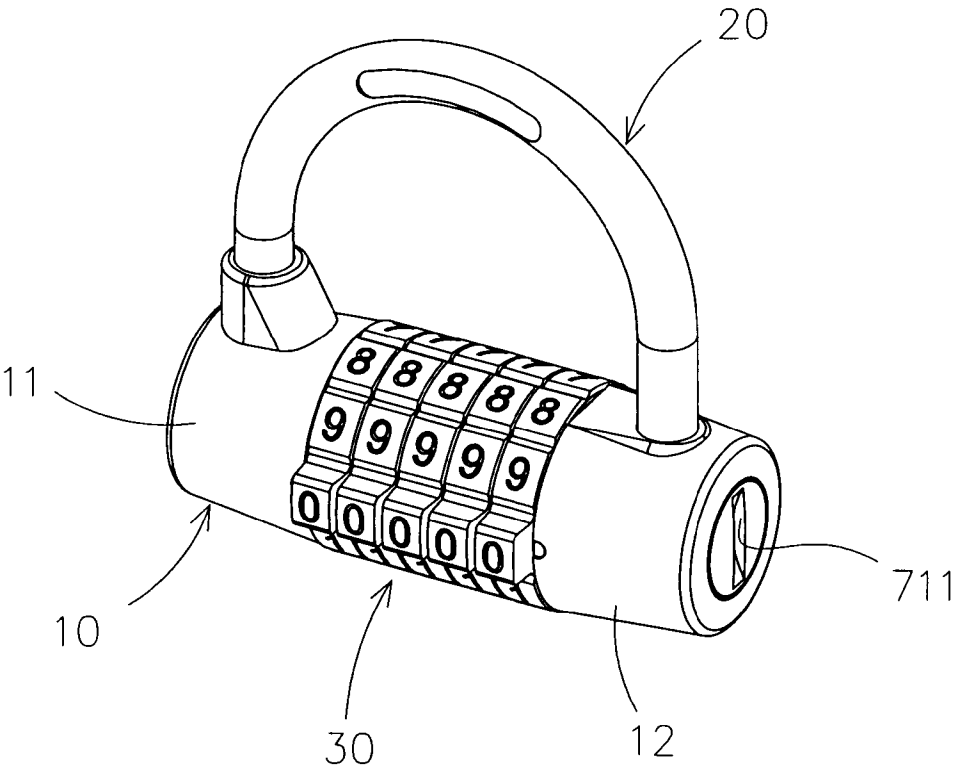
FIG. 1 is a perspective view of a combination lock according to a preferred embodiment of the present invention.

Referring to FIG. 1, FIG. 2, FIG. 3A and FIG. 3B of the drawings, a combination lock according to a preferred embodiment of the present invention is illustrated. According to the preferred embodiment of the present invention, the combination lock comprises a lock body 10, a locking latch 20, a numerical actuation unit 30, and a password reset unit.

The lock body 10 has a first latch opening 111 and a second latch opening 121 spacedly formed on the lock body 10 to support the locking latch 20, the numerical actuation unit 30 and the password reset unit.

The locking latch 20 has a coupling end portion 25 slidably mounted at the first latch opening 111 and a detachable end portion 27 detachably engaged at the second latch opening 121.

The numerical actuation unit 30 comprises a lock releasing device 40 slidably supported by the lock body 10 to lock up the detachable end portion 27 of the locking latch 20 at the second latch opening 121, a plurality of locking rings 32 spacedly disposed in the lock body 10 to lock up the lock releasing device 40 in a slidably movable manner, a plurality of ring-shaped number rotors 31 rotatably provided on the lock body 10 to coaxially engage with the locking rings 32 respectively, wherein when the number rotors 31 are rotated at a predetermined number-combination, the locking rings 32 are driven to rotate to unlock the lock releasing device 40, such that the detachable end portion 27 of the locking latch 20 is free to detach from the lock body 10 at the second latch opening 121.

The password reset unit which comprises a reset driver 70 slidably extended at the lock body 10 to couple with the locking rings 32, wherein when the reset driver 70 is moved to drive the locking rings 32 to slidably disengage with the number rotors 31, the number rotors 31 are free to rotate on the lock body 10 to reset a new number-combination, such that when the reset driver 70 is released that the locking rings 32 are slidably returned back within the number rotors 31, the detachable end portion 27 of the locking latch 20 is unlocked once the number rotors 31 are rotated at the new number-combination.

According to the preferred embodiment of the present invention, the lock body 10 comprises a first body portion 11 and a second body portion 12 wherein the first latch opening 111 is formed on the first body portion 11 while the second latch opening 121 is formed on the second body portion 12. Accordingly, the locking latch 20, having a U-shaped cross section, extends from the first latch opening 111 to the second latch opening 121 between the coupling end portion 25 and the detachable end portion 27 respectively. When the lock releasing device 40 is unlocked, the coupling end portion 25 of the locking latch 20 is allowed to slidably and longitudinally move at the first latch opening 111 so as to so as to allow the detachable end portion 27 freely detachable at the second latch opening 121.

Figure 3A:
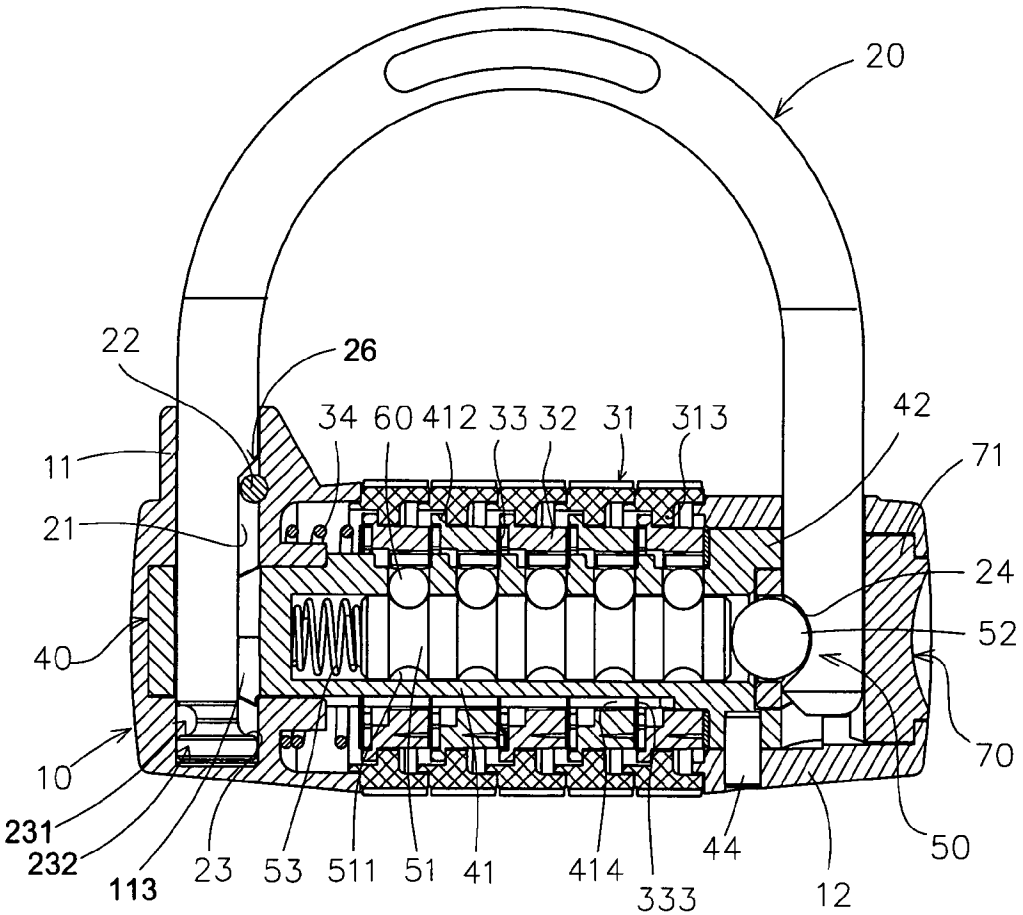
FIG. 3A and FIG. 3B are sectional side views of the combination lock according to the above preferred embodiment of the present invention.

Referring to FIG. 3A of the drawings, the first body portion 11 of the lock body 10 further has a sliding slot 113 formed therein to communicate with the first latch opening 111, wherein the coupling end portion 25 of the locking latch 20 is adapted to slidably move along the sliding slot 113 via the first latch opening 111. Moreover, the locking latch 20 further has a locking surface 21 indently extended along an inner side of the coupling end portion 25 to define a blocking shoulder 26 forming the indention of the locking surface 21. Consequently, the lock body 10 further comprises a blocking member 22 mounted in the first body portion 11 adjacent to the sliding slot 113 to align with the blocking shoulder 26 of the coupling end portion 25 of the locking latch 20. In other words, the blocking member 22 substantially blocks a downward movement of the coupling end portion 25 by biasing against the blocking shoulder 26.

On the other hand, the locking latch 20 further comprises a retention platform 23 downwardly extended from the coupling end portion 25 of the locking latch 20 to correspond with the blocking member 22, wherein the retention platform 23 has a contracted portion 231 having a diameter smaller than a diameter of the coupling end portion 25 of the locking latch 20, and an enlarged portion 232 downwardly extended from the contracted portion 231 to align with the blocking member 22 so that when the locking latch 20 is unlocked, the coupling end portion 25 is free to move upwardly along the sliding slot 113 until the a top surface of the enlarged portion 232 of the retention platform 23 biases against the blocking member 22.

Figure 2:
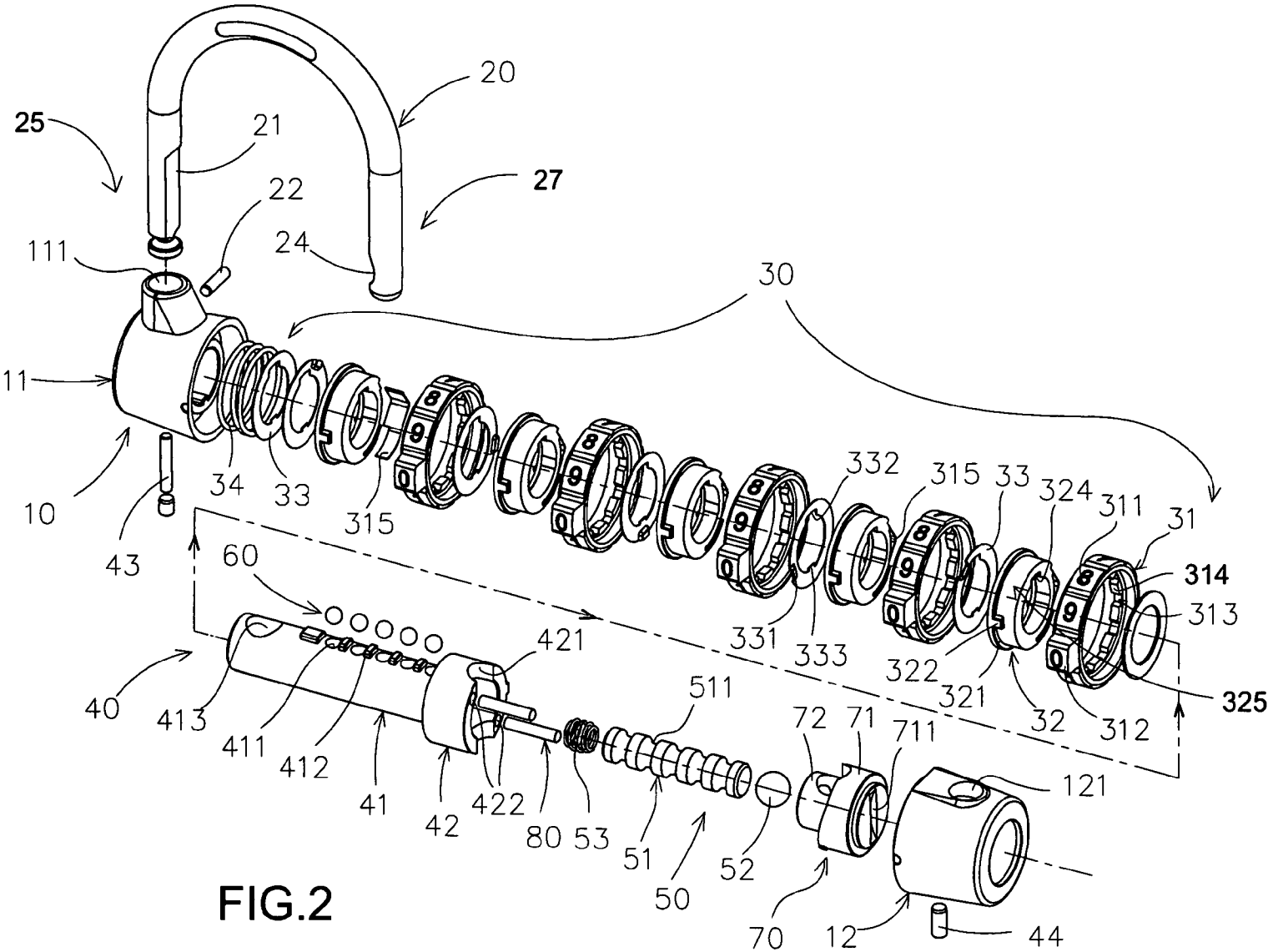
FIG. 2 is an exploded perspective view of the combination lock according to the above preferred embodiment of the present invention.
Figure 3B:
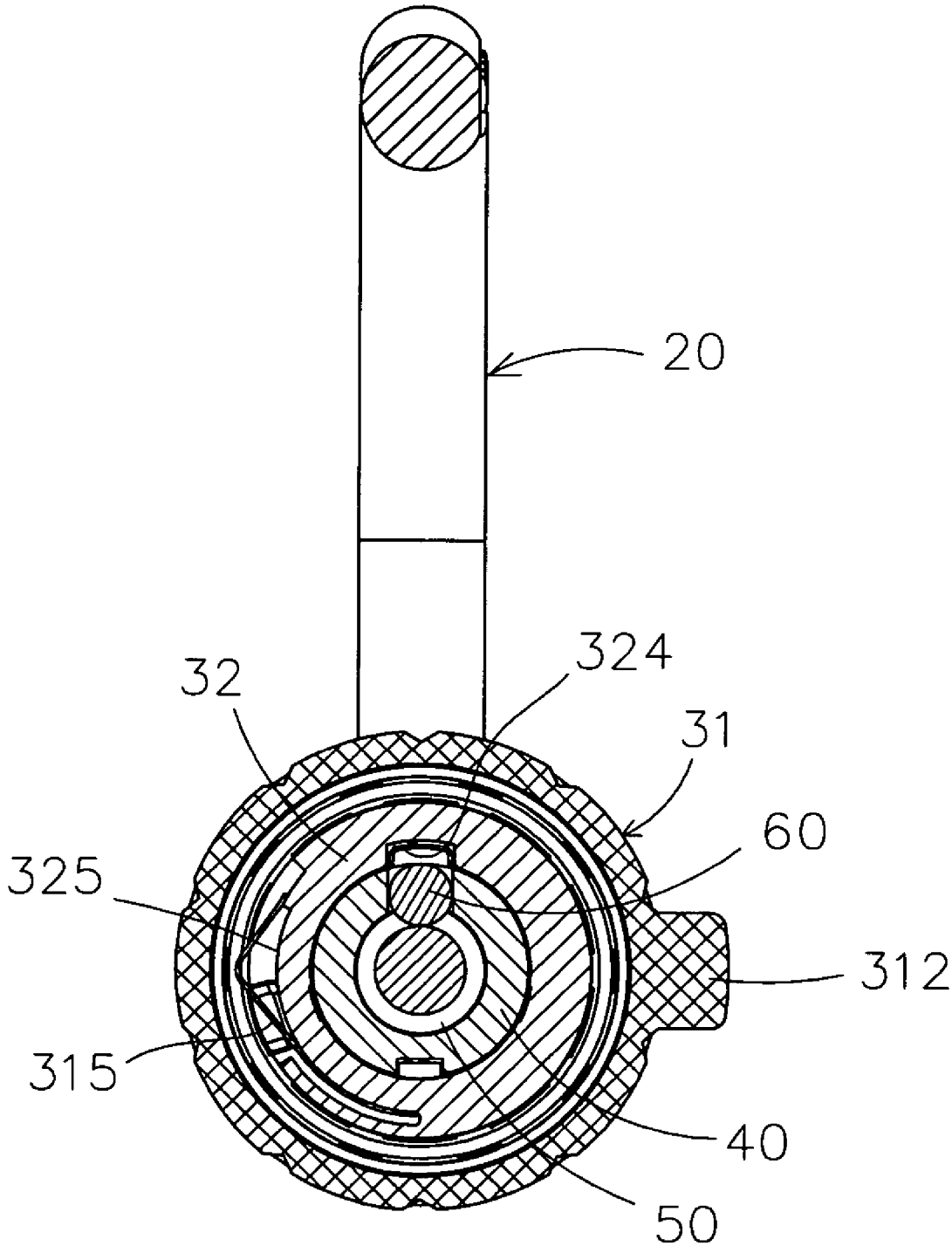
Figure 4A:
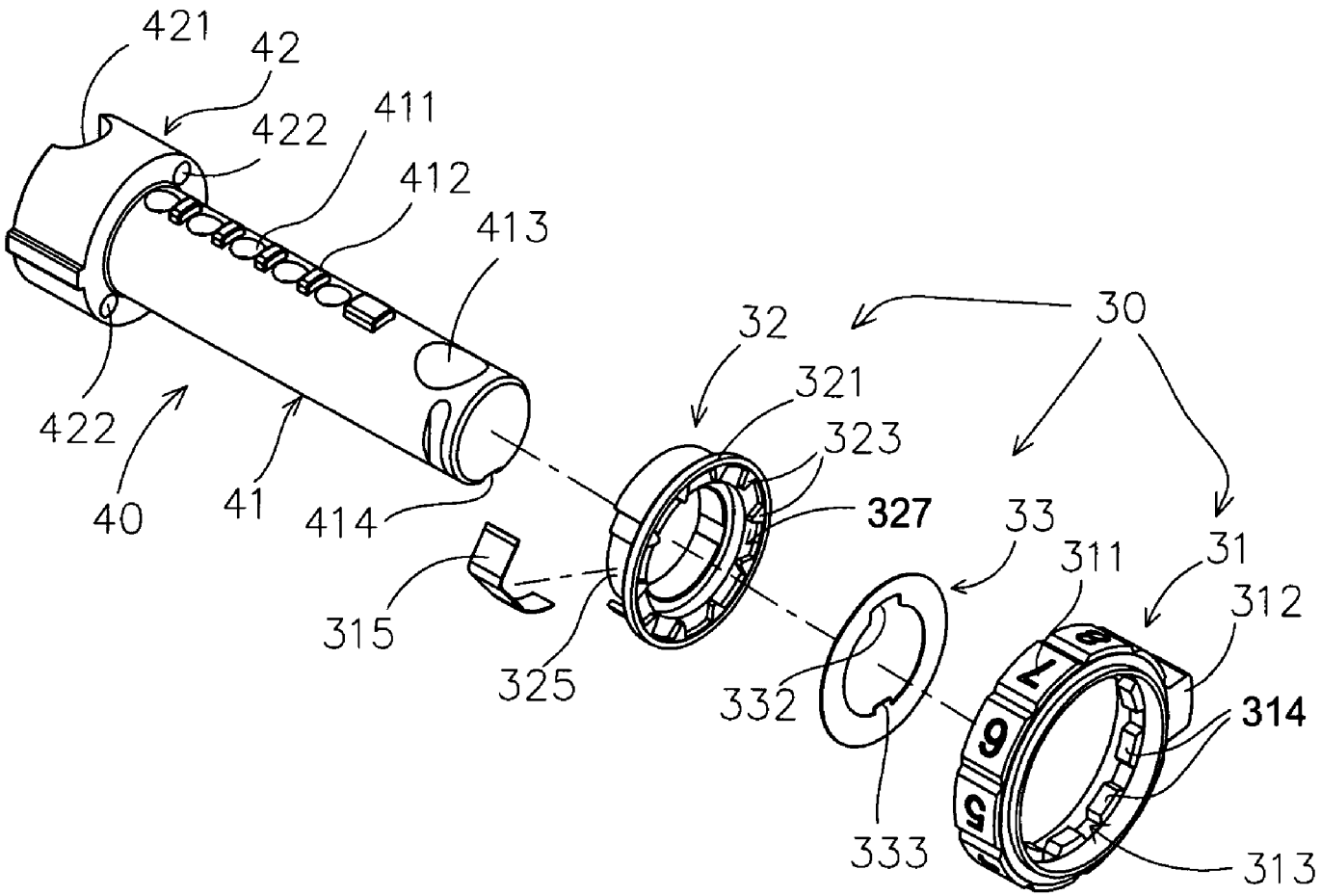
FIG. 4A and FIG. 4B are schematic views of the numerical actuation unit according to the above preferred embodiment of the present invention.
Figure 4B:
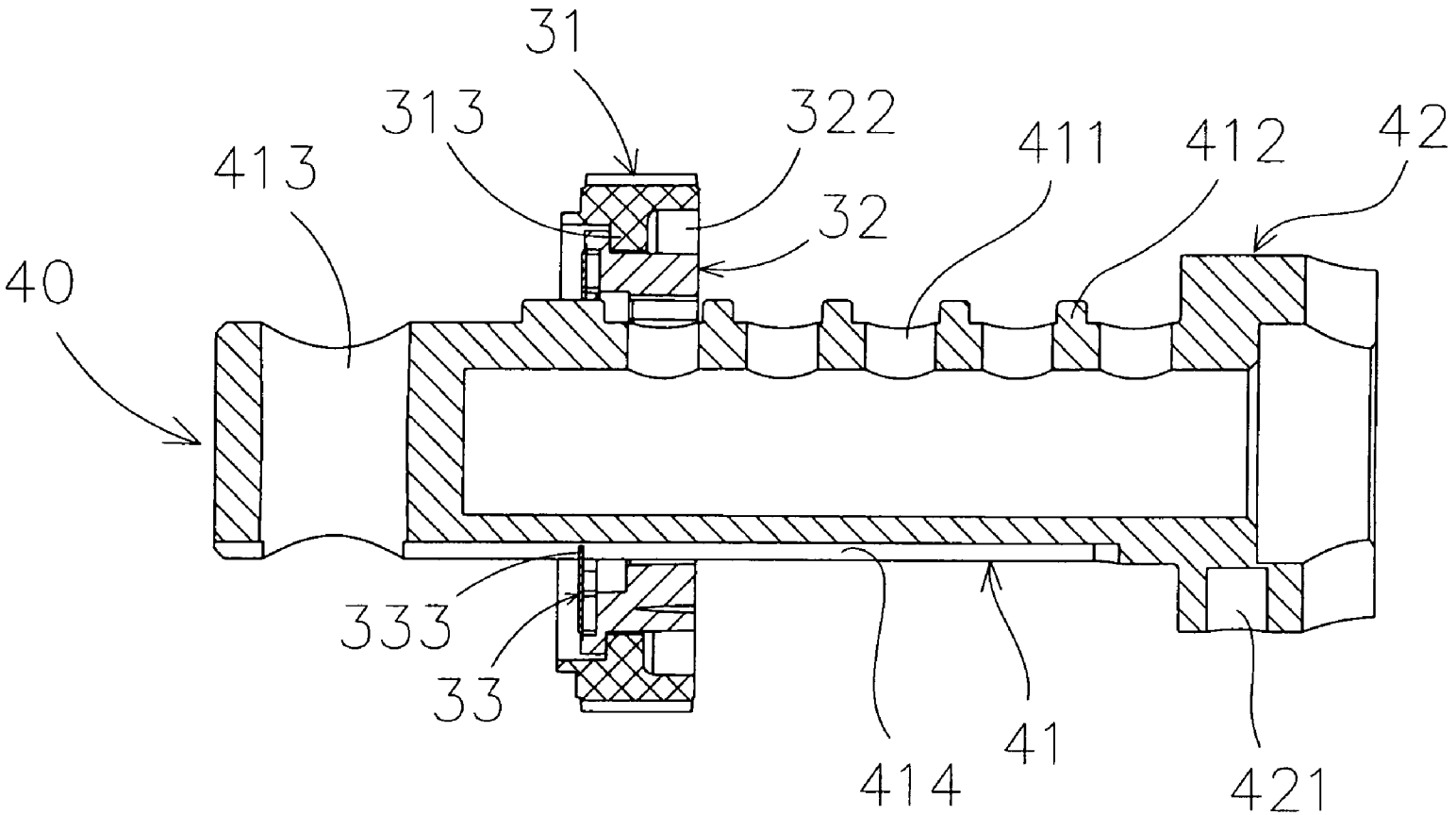

Referring to FIG. 2, FIG. 4A and FIG. 4B of the drawings, each of the number rotors 31 are rotatably supported on the lock releasing device 40 which is supported between the first body portion 11 and the second body portion 12, wherein each of the number rotors 31 has a plurality of number marks 311 formed on an outer surface of the number rotors 31 for providing a selection of number for the respective number rotors 31. The number marks 311 for each of the number rotors 31 are, consecutively, '0', '1', '2', '3', '4', '5', '6', '7', '8' and '9'. According to the preferred embodiment of the present invention, each of the number rotors 31 further has an outer protruding member 312 outwardly and radially protruded from an outer circular surface of the number rotor 31, wherein the number mark '0' is formed on an outer surface of the protruding member 312, as shown in FIG. 3B and FIG. 4A of the drawings.

As mentioned earlier, each of the number rotors 31 has a ring-shaped cross section, wherein each of the number rotors 31 further has a plurality of inner protruding members 314 centripetally, radially and spacedly extended from an inner circular surface of the number rotor 31 at a position disaligning with the plurality of number marks 311 to so as too define a corresponding number of retention slots 313 between each two adjacent inner protruding members 314. Accordingly, each of the retention slots 313 substantially aligns with the number marks 311 formed on the outer circular surface of the respective number rotor 31.

In other words, each of the number rotors 31 has the plurality of retention slots 313 evenly formed on an inner circumferential side thereof, wherein each of the locking rings 32 has a driving member 322 which is protruded from an outer circumferential side to normally engage with one of the retention slots 313 so as to allow the respective number rotor 31 to drive the locking ring 32 to rotate and is arranged in such a manner that when the reset driver 70 is moved to drive the locking ring 32 to slidably disengage with the respective number rotor 31 that the driving member 322 is moved to disengage with the respective retention slot 313, the respective number rotor 31 is free to rotate for resetting the new number-combination.

Referring to FIG. 4A of the drawings, the lock releasing device 40 comprises a main locking tube 41 having a diameter corresponding with the diameter of the number rotors 31, so that the number rotors 31 are arranged to rotatably mount with the main locking tube 41 which is supported by the lock body 10.

Each of the locking rings 32 has a main ring body 325 and a rim portion 321 integrally and peripherally extended from the main ring body 325, such that an outer diameter of the rim portion 321 is slightly larger than an outer diameter of the main ring body 325. Thus, each driving member 322 is integrally extended from the rim portion 321 to rest on the outer peripheral surface of the main ring body 325. As a result, an outer surface peripheral surface of the driving member 322 is substantially aligned with the peripheral surface of the rim portion 321 of the respective locking ring 32.

Referring to FIG. 4A of the drawings, each of the locking rings 32 further has a plurality of V-shaped protrusions 323 spacedly and sidewardly protruded from a side surface of the main ring body 325 at positions corresponding with the positions of the number markers 311 to define a corresponding number of securing slots 327 between each two adjacent protrusions 323.

Referring to FIG. 3A and FIG. 3B of the drawings, each of the locking rings 32 further has an indented mounting surface formed on an outer peripheral surface of the main ring body 325, wherein the numerical actuation unit 30 further comprises a resilient element 315 mounted at the indented mounting surface of the locking ring 32 for normally applying an urging force towards the respective number rotors 31.

According to the preferred embodiment of the present invention, the driving member 322 of each of the locking rings 32 is arranged to slidably insert into a corresponding retention slots 313 of the respective number rotor 31 in such a manner that when the number rotor 31 rotates with respect to the main locking tube 41, the number rotor 31 will drive the locking ring 32 to rotate in accordance with the rotation of the number rotor 31.

In addition, the numerical actuation unit 30 further comprises a plurality of securing rings 33 each of which is supported between one of the number rotors 31 and the corresponding locking ring 32 for supporting on the main locking tube 41. More specifically, the securing ring 33 has a securing member 331 protruded from a peripheral edge thereof for fittedly inserting into one of the securing slots 327 of the locking ring 32. In order to substantially support on the main locking tube 41, each of the securing rings 33 further has a fastening slot 332 indently formed on an inner edge of the securing ring 33, and a fastening member 333 centrifugally protruded from the inner edge of the securing ring 33 at a position opposite to the fastening slot 332. Referring to FIG. 3B of the drawings, each of the securing rings 33 is securely fastened on the main locking tube 41 at the fastening member 333 while supported between the corresponding number rotor 31 and the locking ring 32.

When one of the number rotors 31 rotates, it drives the corresponding locking ring 32 to rotate as well, while the securing ring 33 is kept stationary because it is securely supported on the main locking tube 41. As a result, when the locking ring 32 rotates, the securing member 331 of the securing ring 33 is guided to disengage from one of the securing slots 327 to engage with another securing slot 327.

Referring to FIG. 2 to FIG. 3A of the drawings, the plurality of number rotors 31, the locking rings 32 and the securing rings 33 are supported along the main locking tube 41 in such a manner that the number rotors 31 are capable of being rotated to match with the numerical-combination for unlocking the locking latch 20. The numerical actuation unit 30 further comprises a resilient member 34 mounted on the first body portion 11 of the lock body 10 for normally applying a longitudinal urging force towards the leftmost locking ring 32 of the numerical actuation unit 30.

Referring to FIG. 2, FIG. 4A and FIG. 4B of the drawings, the main locking tube 41 has a plurality of locker holes 411 spacedly formed therealong, and a plurality of locking member 412 protruded from the main locking tube 41 at positions between each two adjacent locker holes 411 respectively, wherein each of the number rotors 31 is rotatably provided on the main locking tube 41 at positions corresponding with the locker holes 411 respectively. The main locking tube 41 further has two through connecting holes 413, 421 formed at two side end portions thereof to align with the first and the second latching openings 111, 121 of the lock body 10 respectively, wherein the coupling end portion 25 and the detachable end portion 27 of the locking latch 20 are arranged to slidably insert into the two connecting holes 413, 421 via the first and the second latch openings 111, 121 respectively.

The lock releasing device 40 further comprises an enlarged mounting tube 42, having a diameter larger than that of the main locking tube 41, integrally and coaxially extended from a side end portion thereof to movably couple with the second body portion 12 of the lock body 10, and to define a locking shoulder as the boundary transversely formed between the enlarged mounting tube 42 and the main locking tube 41. It is worth mentioning that the enlarged mounting tube 42 has two through pushing holes 422 spacedly formed on the locking shoulder for connecting the password reset unit with the numerical actuation unit 30. Referring to FIG. 2 and FIG. 3A of the drawings, the main locking tube 41 is connected with the first body portion 11 and the second body portion 12 by two mounting pins 43, 44 respectively.

In order to mount the numerical actuation unit 30 with the lock releasing device 40, the main locking tube 41 further has a guiding slot 414 longitudinally extended along a bottommost surface of the main locking tube 41, wherein the fastening member 333 of each of the securing rings 33 are arranged to slidably engage with the guiding slot 414 for slidably connecting the securing rings 33 with the main locking tube 41.

It is then worth mentioning that each of the locking rings 32 further has a releasing slot 324 longitudinally and indently formed on an inner side surface of the locking ring 32, wherein the releasing slot 324 has a cross sectional shape substantially the same as a cross sectional shape of the locking member 412 such that when the locking rings 32 are adapted to be rotate so as to align the releasing slots 324 with the locking members 412 respectively.

Thus, when the number rotor 31 is rotated to drive the respective locking ring 32 to rotate until the releasing slot 324 is aligned with the respective locking member 412 of the locking releasing device 40, the locking releasing device 40 is unlocked for allowing the detachable end portion 27 of the locking latch 20 freely detaching from the lock body 10 at the second latch opening 12.

According to the preferred embodiment of the present invention, the numerical actuation unit 30 further comprises a locking arrangement 50 provided in the main locking tube 41 to communicate with the number rotors 31, the locking rings 32, and the securing rings 33. More specifically, the locking arrangement 50 comprises a locking shaft 51 transversely and slidably extended in the main locking tube 41, an interlocking member 52 supported by the second body portion 12 of the lock body 10 and substantially aligned with the locking shaft 51, and a resilient spring 53 supported by the first body portion 11 of the lock body 10 to normally exert a longitudinal biasing force towards the locking shaft 51 for pushing it towards the interlocking member 52. It is worth mentioning that the interlocking member 52 is preferably embodied as a metallic spherical ball movably supported in the second body portion 12 for interlocking with the detachable end portion 27 of the locking latch 20. Accordingly, the locking latch 20 further has an interlocking slot 24 indently formed on the detachable end portion 27 to align with the interlocking member 52, wherein the interlocking slot 24 has a semi-spherical cross section to partially receive the interlocking member 52 therein. In other words, the locking shaft 51 is adapted to be normally pushed by the resilient spring 53 for pushing the interlocking member 52 to partially receive into the interlocking slot 24 in such a manner that the detachable end portion 24 of the locking latch 20 is interlocked from slidably disengaging from the lock body 10.

In other words, the lock releasing device 40 comprises the main locking tube 41 having the locking members 412 evenly protruding therefrom and a locking shaft 51 coaxially received in the main locking tube 41 in a transversely slidable manner, and means for locking the locking shaft 51 with the main locking tube 41, such that when the releasing slots 324 of the locking rings 32 are rotated to align with the locking members 412, the locking means is released that the locking shaft 51 is allowed to longitudinally slide within the main locking tube 41 so as to allow the detachable end portion 27 of the locking latch 20 freely detaching from the lock body 10 at the second latch opening 121.

Referring to FIG. 2 and FIG. 3A of the drawings, the locking shaft 51 has a plurality of transverse slots 511 transversely, indently, and spacedly formed along the locking shaft 51, wherein each of the transverse slots 511 is substantially aligned with the locker holes 411 of the main locking tube 41. In other words, the number of transverse slots 511 is corresponding with the number of the locker holes 411 whose number is corresponding to that of the number rotors 31. The numerical actuation unit 30 further comprises a plurality of spherical lockers 60 which is substantially supported at top portions transverse slots 511 respectively in which each of the spherical lockers 60 is partially exposed out of the main locking tube 41 via the respective locker hole 411.

The locking means then also has the plurality of locker holes 411 evenly formed on the main locking tube 41 adjacent to the locking members 412 respectively and a plurality of spherical lockers 60 disposed at the locker holes 411 to lock up the locking shaft 51 within the main locking tube 41.

It is worth mentioning the spherical lockers 60 that a width of each of the transverse slots 511 is slightly smaller than a diameter of the respective spherical locker 60 so that the spherical locker 60 is capable of being substantially supported at the corresponding locker holes 411.

Referring to FIG. 2, FIG. 5A, FIG. 5B, FIG. 6A and FIG. 6B of the drawings, the password reset unit comprises a tubular reset knob mounted on the second body portion 12 of the lock body 10 to couple with the reset driver 70 and is arranged in such a manner that when the reset knob is rotated, the reset driver 70 is driven to push the locking rings 32 to disengage with the number rotors 31 for allowing the number-combination to be reset. The lock body 10 further has a through reset slot formed on an outer sidewall of the second body portion 12 wherein the reset driver is operatively mounted on the second body portion 12 at the reset slot for communicating the lock releasing device 40 with an exterior of the lock body 10.

According to the preferred embodiment of the present invention, the tubular reset knob has a first knob portion 71 and a second knob portions 72 which is coaxially and integrally extended from the first knob portion 71, wherein the second knob portion 72 has a diameter slightly smaller than a diameter of the first knob portion 71, while the first knob portion 71 has a diameter corresponding with a diameter of the reset slot so that the first knob portion 71 is adapted to fittedly received in the second body portion 12 via the reset knob.

Moreover, the reset knob further has an elongated adjustment slot 711 formed on an outer side surface of the first knob portion 71 wherein the adjustment slot 711 has a predetermined width for being effectively turned by a predetermined external object, such as a coin. In other words, the reset knob is rotatably supported at the second body portion 12 of the lock body 10 in such a manner that it is adapted to be driven to rotate from the adjustment slot 711, wherein the second knob portion 72 is arranged to receive in the enlarged mounting tube 42 so that an inner side surface of the first knob portion 71 is adapted to communicate with an outer side surface of the enlarged mounting tube 42.

Figure 5A:
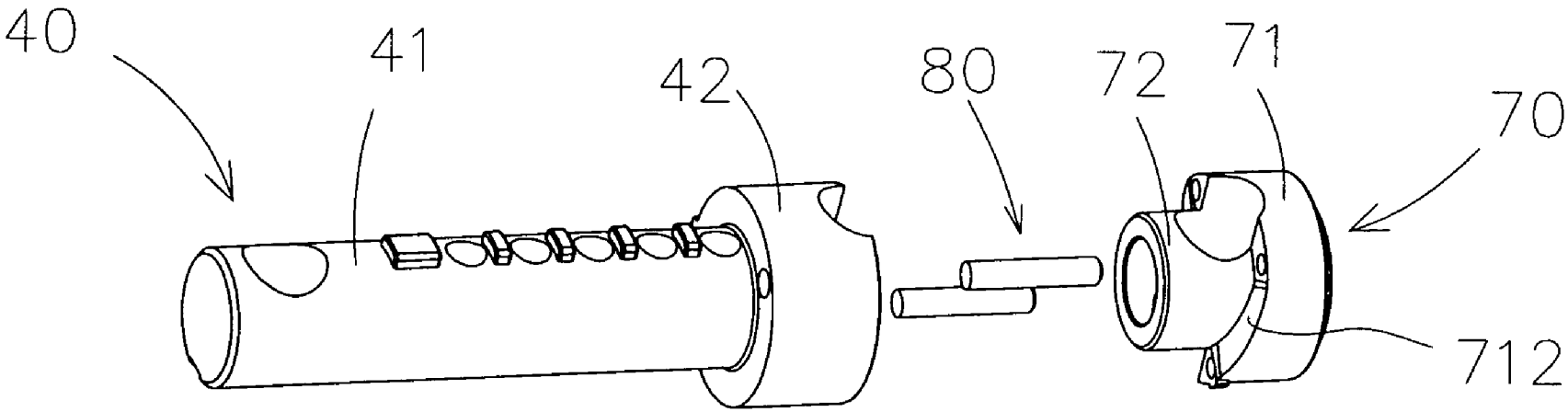
FIG. 5A and FIG. 5B are schematic views of the password reset unit according to the above preferred embodiment of the present invention.
Figure 5B:
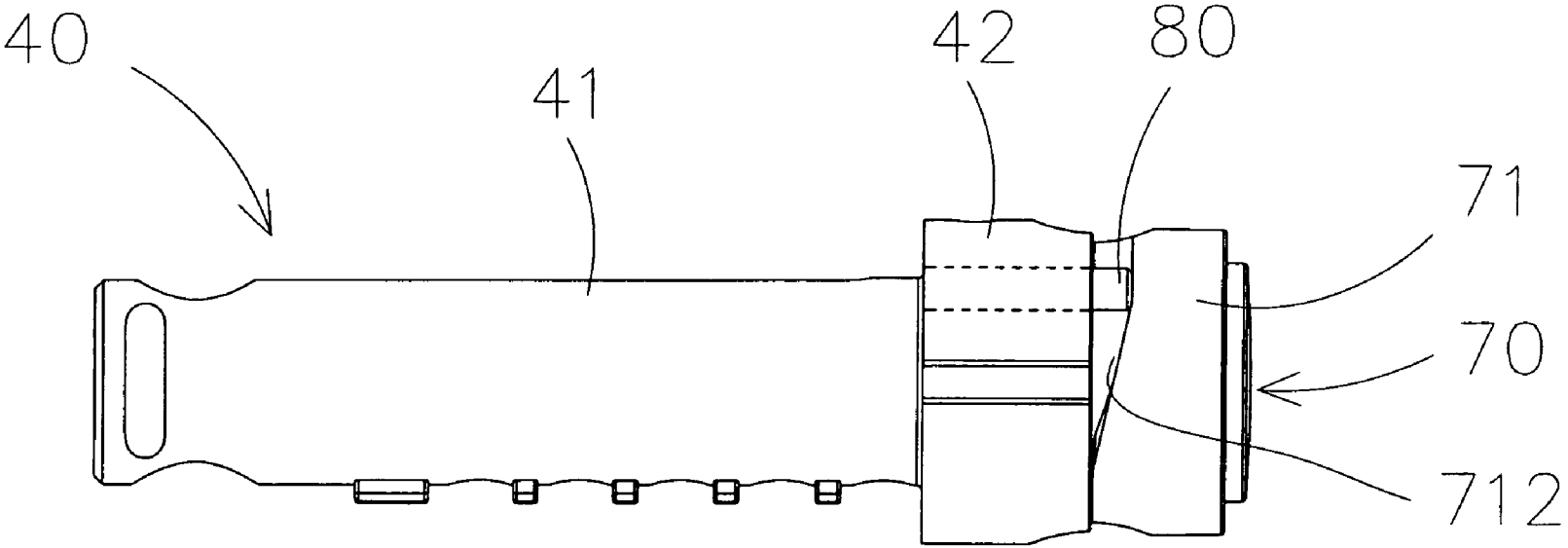
Figure 6A:
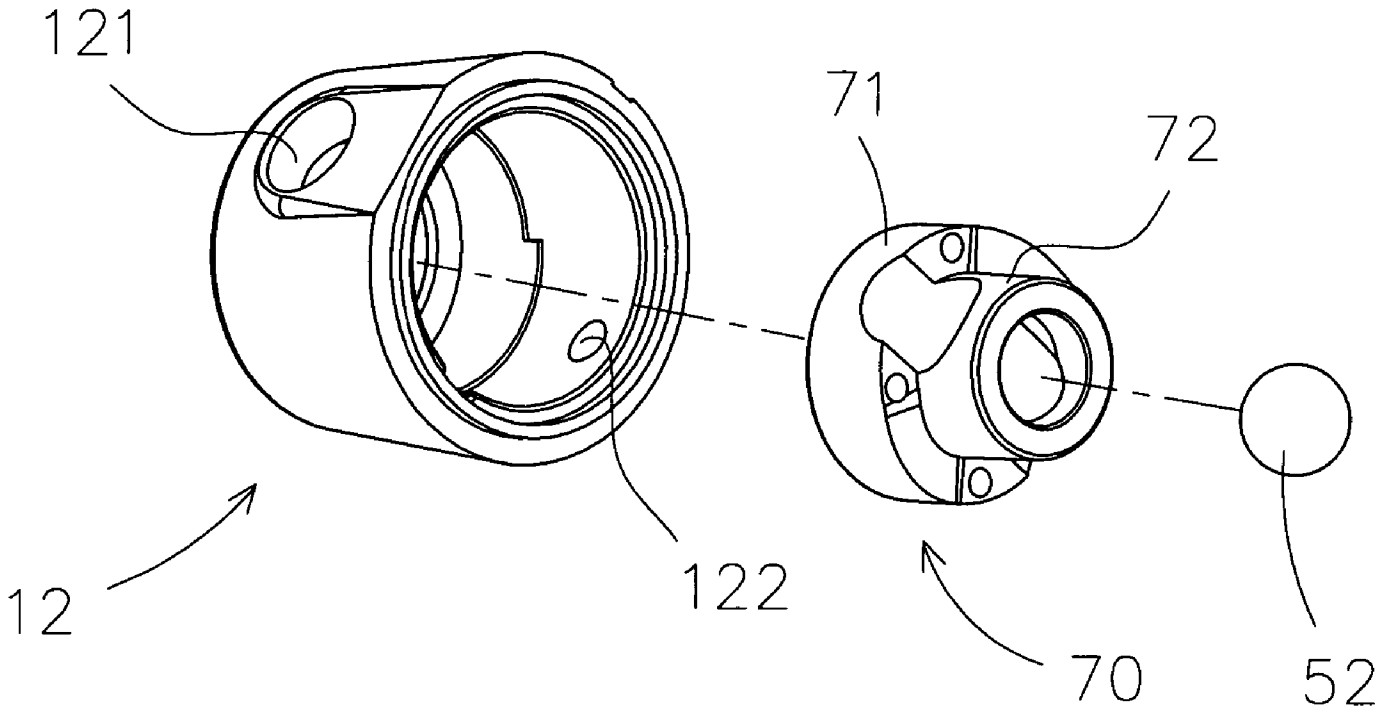
FIG. 6A and FIG. 6B are schematic views of the password reset unit according to the above preferred embodiment of the present invention.
Figure 6B:
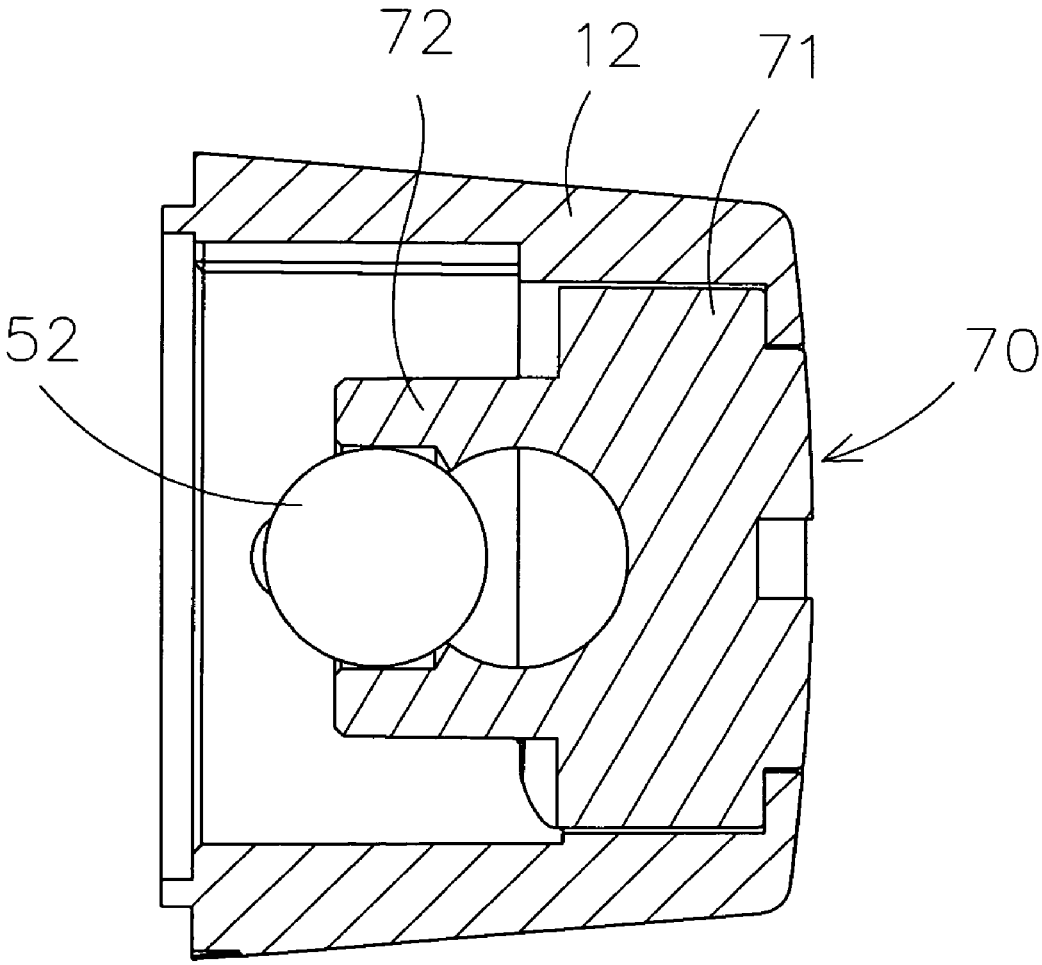

Referring to FIG. 5B of the drawings, the reset driver 70 further comprises two disengaging members 80 movably extended from an inner side surface of the first knob portion 71, wherein the inner side surface of the first knob portion 71 has an uneven surface curvature, such that when the reset knob is driven to rotate, the inner side surface of the first knob portion 71 is arranged to push the disengaging members 80 towards the lock releasing device 40 for pushing the locking rings 32 disengaging with the respective number rotors 31 so as allow resetting of the number-combination, i.e. the password of the combination lock. In other words, the disengaging members 80 are adapted to slidably penetrating through the pushing holes 422 respectively for longitudinally pushing the locking rings 32 disengaging with the respective number rotors 31.

More specifically, the inner surface of the reset knob is a slanted surface 712 biasing against the respective end of the disengaging member 80, such that when the reset knob is driven to rotate, the respective end of the disengaging member 80 is slid on the inner surface of the reset knob to push the locking rings 32 to disengage with the number rotors 31 respectively.

In other words, the disengaging member 80, which is transversely and slidably supported within the lock body 10, having two ends coupling with an inner surface of the reset knob and the locking rings 32 respectively, such that when the reset knob is rotated, the disengaging member 80 is driven to push the locking rings 32 disengaging with the number rotors 31 respectively for allowing resetting of the number-combination.

The operation of the present invention is as follows: when the locking latch 20 is locked, i.e. the positions of the number rotors 31 do not match with the predetermined number-combination, the locking rings 32 and the securing rings 33 are blocked to move longitudinally by the respective locking members 412 in such a manner that the locking shaft 51 is restricted from moving longitudinally along the lock body 10. In other words, since the locking shaft 51 is locked from moving longitudinally, the locking latch 20 is restricted from detaching from the lock body 10.

In order to unlock the locking latch 20, a user needs to rotate the number rotors for matching the numbers with the predetermined number-combination of the numerical actuation unit 30. When the number rotors 31 are rotated to match with the number-combination, the fastening slots 332 of all the securing rings 33 and the releasing slots 324 of the locking rings 32 are arranged to align with the locking members 412 so that the locking shaft 51 is capable of longitudinally sliding between the first body portion 11 and the second body portion 12. At the same time, since the locking shaft 51 is capable of longitudinally moving between the two body portions 11, 12, a user is able to upwardly pull the locking latch 20 so that the detachable end portion 27 is also pulled upwardly for pushing the interlocking member 52 to move sidewardly so as to detach the detachable end portion 27 from the second body portion 12.

When a user wishes to reset the number-combination of the combination lock, he/she needs to rotate the first knob portion 71 of the tubular reset knob in order to push the disengaging members 80 to push the locking rings 32 disengaging with the number rotors 31. At this point, the user is able to reset the number-combination. After resetting, the user needs to rotate the first knob portion 71 in the reverse direction, such that the resilient member 34 normally applies the urging force towards the locking rings 32 for restoring them to their original position, i.e. re-engaging with the number rotors 31.

From the forgoing descriptions, it can be shown that the above-mentioned objects have been substantially accomplished. The present invention provides a combination lock which comprising a password reset unit received in a lock body for preventing it from being accidentally actuated.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A combination lock, comprising:

a lock body having a first body portion defining a first latch opening and an opposed second body portion affixing to said first body portion and defining a second latch opening at said second body portion;

a locking latch having a coupling end portion slidably mounted at said first latch opening and a detachable end portion detachably engaged at said second latch opening;

a numerical actuation unit which comprises a lock releasing device, having two spaced apart through pushing holes, slidably supported in said lock body to lock up said detachable end portion of said locking latch at said second latch opening, a plurality of locking rings spacedly and coaxially disposed in said lock body to lock up said lock releasing device in a slidably movable manner, a plurality of ring-shaped number rotors rotatably provided on said lock body to coaxially engage with said locking rings respectively, wherein when said number rotors are rotated at a predetermined number-combination, said locking rings are driven to rotate to unlock said lock releasing device, such that said detachable end portion of said locking latch is free to detach from said lock body at said second latch opening; and a password reset unit which comprises a reset knob rotatably disposed in said second body portion of said lock body, and two disengaging members sliding along said two pushing holes of said lock releasing device respectively, wherein each of said disengaging members has a first end biasing against an inner side surface of said reset knob and a second end biasing against said locking rings in such a manner that when said rest knob is rotated within said second body portion of said lock body to push said disengaging members towards said first body portion thereof, said locking rings are slidably moved along said lock releasing device to disengage with said number rotors such that said number rotors are free to rotate on said lock body to reset a new number-combination, wherein when said reset knob is released that said locking rings are slidably returned back within said number rotors, said detachable end of said locking latch is unlocked once said number rotors are rotated at said new number-combination.

2. The combination lock, as recited in claim 1, wherein said reset knob has an elongated adjustment slot formed on an outer side surface thereof for engaging with an external object through second body portion of said lock body, such that said reset knob is adapted to be rotated within said second body portion of said lock body via said adjustment slot.

3. The combination lock, as recited in claim 1, wherein said inner surface of said reset knob is a slanted surface biasing against said first ends of said disengaging members, wherein when said reset knob is driven to rotate with said first body portion of said lock body, said first ends of said disengaging members are pushed by said slanted surface of said reset knob to slidably push said locking rings to disengage with said number rotors.

4. The combination lock, as recited in claim 2, wherein said inner surface of said reset knob is a slanted surface biasing against said first ends of said disengaging members, wherein when said reset knob is driven to rotate with said first body portion of said lock body, said first ends of said disengaging members are pushed by said slanted surface of said reset knob to slidably push said locking rings to disengage with said number rotors.

5. The combination lock, as recited in claim 1, wherein said lock releasing device comprises a main locking tube having a plurality of locking members evenly protruding therealong and a plurality of locker holes evenly formed along said main locking tube at a position adjacent to said locking members respectively, a locking shaft coaxially received in said main lock tube in a transversely slidable manner, and a plurality of spherical lockers disposed at said locker holes respectively to lock up said locking shaft within said main locking tube, wherein when said number rotors are rotated to unlock said locking rings, said spherical lockers are free to move to unlock said locking shaft, such that said locking shaft is free to slide within said main locking tube for allowing said detachable end portion of said locking latch to freely detach from said lock body at said second latch opening.

6. The combination lock, as recited in claim 2, wherein said lock releasing device comprises a main locking tube having a plurality of locking members evenly protruding therealong and a plurality of locker holes evenly formed along said main locking tube at a position adjacent to said locking members respectively, a locking shaft coaxially received in said main lock tube in a transversely slidable manner, and a plurality of spherical lockers disposed at said locker holes respectively to lock up said locking shaft within said main locking tube, wherein when said number rotors are rotated to unlock said locking rings, said spherical lockers are free to move to unlock said locking shaft, such that said locking shaft is free to slide within said main locking tube for allowing said detachable end portion of said locking latch to freely detach from said lock body at said second latch opening.

7. The combination lock, as recited in claim 4, wherein said lock releasing device comprises a main locking tube having a plurality of locking members evenly protruding therealong and a plurality of locker holes evenly formed along said main locking tube at a position adjacent to said locking members respectively, a locking shaft coaxially received in said main lock tube in a transversely slidable manner, and a plurality of spherical lockers disposed at said locker holes respectively to lock up said locking shaft within said main locking tube, wherein when said number rotors are rotated to unlock said locking rings, said spherical lockers are free to move to unlock said locking shaft, such that said locking shaft is free to slide within said main locking tube for allowing said detachable end portion of said locking latch to freely detach from said lock body at said second latch opening.

8. The combination lock, as recited in claim 5, wherein said lock releasing device further comprises an enlarged mounting tube, having a diameter larger than that of said main locking tube, integrally and coaxially extended from said main locking tube, wherein said two pushing holes are longitudinally extended at said mounting tube to guide said disengaging members sliding towards said locking rings.

9. The combination lock, as recited in claim 6, wherein said lock releasing device further comprises an enlarged mounting tube, having a diameter larger than that of said main locking tube, integrally and coaxially extended from said main locking tube, wherein said two pushing holes are longitudinally extended at said mounting tube to guide said disengaging members sliding towards said locking rings.

10. The combination lock, as recited in claim 7, wherein said lock releasing device further comprises an enlarged mounting tube, having a diameter larger than that of said main locking tube, integrally and coaxially extended from said main locking tube, wherein said two pushing holes are longitudinally extended at said mounting tube to guide said disengaging members sliding towards said locking rings.

11. The combination lock, as recited in claim 1, wherein each of said number rotors has a plurality of retention slots evenly formed on an inner circumferential side thereof, wherein each of said locking rings has a driving member which is protruded from an outer circumferential side to normally engage with one of said retention slots to allow said respective number rotor to drive said locking ring to rotate and is arranged in such a manner that when said reset knob is rotated to drive said locking rings through said disengaging members to slidably disengage with said respective number rotor that said driving member is moved to disengage with said respective retention slot, said respective number rotor is free to rotate for resetting said new number-combination.

12. The combination lock, as recited in claim 7, wherein each of said number rotors has a plurality of retention slots evenly formed on an inner circumferential side thereof, wherein each of said locking rings has a driving member which is protruded from an outer circumferential side to normally engage with one of said retention slots to allow said respective number rotor to drive said locking ring to rotate and is arranged in such a manner that when said reset knob is rotated to drive said locking rings through said disengaging members to slidably disengage with said respective number rotor that said driving member is moved to disengage with said respective retention slot, said respective number rotor is free to rotate for resetting said new number-combination.

13. The combination lock, as recited in claim 10, wherein each of said number rotors has a plurality of retention slots evenly formed on an inner circumferential side thereof, wherein each of said locking rings has a driving member which is protruded from an outer circumferential side to normally engage with one of said retention slots to allow said respective number rotor to drive said locking ring to rotate and is arranged in such a manner that when said reset knob is rotated to drive said locking rings through said disengaging members to slidably disengage with said respective number rotor that said driving member is moved to disengage with said respective retention slot, said respective number rotor is free to rotate for resetting said new number-combination.

14. The combination lock, as recited in claim 11, further comprising a plurality of securing rings each of which is supported between every said two adjacent number rotors and is coaxially supported said lock releasing device, wherein each of said securing ring has a securing member protruded from a peripheral edge for fittingly inserting into one of securing slots of said locking ring, wherein when said number rotors are driven to rotate, said securing rings are kept stationary that said securing member of said securing ring is guided to disengage from said corresponding securing slot to re-engage with another said corresponding securing slot.

15. The combination lock, as recited in claim 12, further comprising a plurality of securing rings each of which is supported between every said two adjacent number rotors and is coaxially supported said lock releasing device, wherein each of said securing ring has a securing member protruded from a peripheral edge for fittingly inserting into one of securing slots of said locking ring, wherein when said number rotors are driven to rotate, said securing rings are kept stationary that said securing member of said securing ring is guided to disengage from said corresponding securing slot to re-engage with another said corresponding securing slot.

16. The combination lock, as recited in claim 13, further comprising a plurality of securing rings each of which is supported between every said two adjacent number rotors and is coaxially supported said lock releasing device, wherein each of said securing ring has a securing member protruded from a peripheral edge for fittingly inserting into one of securing slots of said locking ring, wherein when said number rotors are driven to rotate, said securing rings are kept stationary that said securing member of said securing ring is guided to disengage from said corresponding securing slot to re-engage with another said corresponding securing slot.

* * * * *